US005353846A

United States Patent [19]

Gheysen et al.

[11] Patent Number: 5,353,846

[45] Date of Patent: Oct. 11, 1994

[54] LIFTER MECHANISM FOR JACQUARD MACHINE

[75] Inventors: Nico Gheysen, Sint-Eloois-Winkel; Puype Lode, Kortrijk; Carlos Derudder, Heule; André Dewispeleare, Kortrijk-Marke, all of, Belgium

[73] Assignee: N.V. Michel Van De Wiele, Kortrijk-Marke, Belgium

[21] Appl. No.: 63,931

[22] Filed: May 19, 1993

[30] Foreign Application Priority Data

May 19, 1992 [BE] Belgium ..... 09 200461

[51] Int. Cl.[5] ..... D03C 3/00

[52] U.S. Cl. ..... 139/65

[58] Field of Search ..... 139/65, 85; 254/396

[56] References Cited

U.S. PATENT DOCUMENTS 5,038,837 8/1991 Falau et al. ..... 139/65
5,139,052 8/1992 Derudder ..... 139/65

FOREIGN PATENT DOCUMENTS 529019 6/1954 Belgium .
548296 6/1956 Belgium .
549280 6/1956 Belgium .
2939714 10/1980 Fed. Rep. of Germany .
609113 9/1960 Italy ..... 139/65

*Primary Examiner*—Andrew M. Falik
*Attorney, Agent, or Firm*—Brumbaugh, Graves, Donohue & Raymond

[57] ABSTRACT

A lifter mechanism for a Jacquard machine is connected to two hooks. This mechanism has one lifter element with two rollers and one roller element. This mechanism also has one lifter cord passing around under the top roller of the lifter element and is fixed by each end to one of the hooks while the roller element is immovably fixed below the lifter element. The mechanism has an additional lifter cord which is fixed by one end next to the other lifter cord to one of the hooks. This lifter cord is passed around under the roller of the roller element, around over the bottom roller of the lifter element, and is extended back down, where it connected to the warp threads. The rollers are placed on shafts, which, in a horizontal plane, form an angle ($\alpha$) relative to a line parallel to the direction of the knives. The roller of the roller element is placed on a shaft which, in a horizontal plane along the other side, forms an angle ($\beta$) relative to a line parallel to the direction of the knives, while the outsides of the flank pieces and of the side plates are situated in vertical planes lying at right angles to the direction of the knives.

19 Claims, 5 Drawing Sheets

LIFTER MECHANISM FOR JACQUARD MACHINE

FIELD OF THE INVENTION

The invention described below relates to a lifter mechanism for a Jacquard machine.

BACKGROUND OF THE INVENTION

It is known that in conjunction with a face-to-face weaving loom a Jacquard machine ensures that the various pile warp threads are placed in the correct position before each pick, so that the fabric is woven according to the desired weave, with the desired patterns.

Such Jacquard machines comprise at least two rows of hooks and two knives constantly moving up and down in counterphase opposite each row of hooks, which knives can carry along the hooks of that row, while each hook as desired can be held by a selection mechanism or otherwise in its top or bottom position (depending on the design of the Jacquard machine), for the duration of one or more cycles of the knives.

Two of such rows of hooks are called complementary rows of hooks, and two hooks situated directly opposite each other, each belonging to one of two complementary rows of hooks, are known as a complementary set of hooks. The hooks of one or two complementary sets of hooks, through the interaction imposed by interconnection of said hooks, lifter rollers, lifter cords placed around said rollers, and warp threads connected to a lifter cord, can move one or more warp threads (by means of a harness cord) to various heights, as a result of the different positions of the interacting hooks. In other words, by selecting or not selecting each of the hooks which interact with the same lifter mechanism, the warp threads connected to a lifter cord of said lifter mechanism can be moved into the desired position before each pick, in order to produce a face-to-face fabric. This principle is known and is illustrated with reference to the example which follows, in which reference is made to the appended FIG. 1.

For weaving certain weaves in face-to-face fabrics, it is necessary that in two successive picks the pile warp threads can be placed in three possible positions relative to the weft threads in top fabric and bottom fabric: above said weft threads, below said weft threads, and between said weft threads. These are known as the positions Above, Below and Middle respectively. For achieving these three selection possibilities, use is made of three lifter elements (1), (2), (3) (see FIG. 1). Each lifter element is composed of two rotary rollers (1', 1''), (2', 2''), (3', 3'') situated above one another.

The two hooks of two sets of complementary hooks (9), (10) and (9'), (10') are connected by a downward-hanging lifter cord (7), (8) respectively, while the downward-hanging part is passed round under the top roller (1') of the lifter element (1) and under the top roller (2') of lifter element (2) respectively.

A lifter cord (6) is connected by one end in a fixed point lower down than the rollers (1'') and (2''), is guided over the roller (1'') of lifter element (1), has a downward-hanging part which is passed under the top roller (3') of lifter element (3), and is finally guided over the roller (2'') of lifter element (2) and fixed by the other end in a fixed point situated lower down.

Lifter cord (4) runs over the bottom roller (3'') of the bottom lifter element (3) and is connected by one end lower down, by means of the harness cord, to one or more pile warp threads, and is connected by the other end to a fixed or movable (controllable) point or grate (5).

If none of the four hooks is selected, then hook (9), on the one hand, moves up and down in counterphase with hook (10), and hook (9'), on the other hand, moves in counterphase with hook (10'). The lifter elements (1) and (2) consequently remain at the same height. No lift takes place, and the pile warp threads remain in the "below" position.

If one of the hooks, for example hook (9), is selected in its top position, after hook (10) is raised by the knife (over a height h) the lifter element (1) is raised over a height h/2. Lifter element (2) is not raised, since neither hook (9') nor hook (10') were selected. The lifting of lifter element (1) over a height h/2 results in the same lift (over height h/2) of lifter element (3), as a result of which the pile warp threads are raised over a height h. They are taken into the "middle" position. When hook (10) is in its lowest position, the warp threads are in the "below" position.

If one hook (e.g. (9) and (9')) of each set of complementary hooks is now selected in its top position, then both lifter elements (1) and (2) are raised over a height h/2 when the complementary hooks (10) and (10') are raised. This results in a lift over a height h of lifter element (3), as a result of which the pile warp threads are raised over a height 2h. They are taken into the "above" position. When the hooks (10), (10') are moved into their lowest position, the pile warp threads are in the "below" position.

Through the different selection possibilities of the hooks and through moving the grate (5) to a different level, possibly together with one of the hooks, the pile warp threads can be taken into three possible positions on two successive picks.

The great disadvantage of this known lifter mechanism lies in the fact that two complementary sets of hooks (9, 10), (9', 10') are necessary, which results in a bulky and expensive machine.

This disadvantage is eliminated by the lifter mechanisms which are disclosed in Belgian Patent No. 09000559, filed on 31 May 1990.

It relates to a lifter mechanism for a Jacquard machine, to which only one set of complementary hooks need be connected, and by which selection or non-selection of these hooks provides the possibility of placing the warp threads in 3 possible positions for each 2-shot pattern repeat.

The abovementioned patent describes two possible embodiments which are illustrated in the appended FIG. 2. In a first embodiment, one end of a downward-hanging lifter cord (13) is fixed to each of two complementary hooks (11), (12). This lifter cord (13) is passed round the top roller (14') of a lifter element (14). Fixed to one of the hooks (11), (12) is the end of a second lifter cord (15), which hangs down lower than the lifter element (14) and is passed below the top roller (17') of a lifter element (17) and is then taken back up and runs over the bottom roller (14'') of lifter element (14) and is connected to a fixed or controllable grate (16) back down lower than said roller (14''). Over the bottom roller (17'') of this lifter element (17) lies a third lifter cord (18) which is connected by one end lower down to one or more pile warp threads (by means of harness cords), and is connected by the other end lower down than the bottom roller (17'') of the lifter element (17) to a fixed or controllable grate (19).

In the second embodiment, the top lifter element (14) is fixed to one of the two complementary hooks (11) and (12), while another lifter cord (21) is connected by one end to the other hook (12), lower down than lifter element (14), is passed under the top roller (17') of a lifter element (17), and runs back up, is placed over the bottom roller (14'') of lifter element (14) and is connected back lower down by the other end to a fixed or controllable grate (16). Over the bottom roller (17'') of lifter element (17) runs a lifter cord (18) which is connected by one end—lower down—by means of harness cords to the pile warp threads, and is connected by the other end—also at a lower level—to a fixed or controllable grate (19).

If hook (11)—or (12)—is selected in its top position and the grates (16), (19) are assumed to be fixed, then the warp threads—after the raising of the other hook (12) or (11)—are raised over a height 2h and move from the "Below" position to the "Above" position.

If no hook at all is selected, the warp threads are raised by lifting hook (11) over a height h and taken from the "Below" position to the "Middle" position.

If the mechanism is now provided with means by which one of the grates (for example, grate (16)) is raised by knife (12') together with hook (12) over a height h, after the lifting of hook (12) the warp threads go a distance h lower than was the case with fixed grate.

For a more detailed description of all possibilities of these known lifter mechanisms, we refer you to Belgian Patent No. 9000559.

The lifter mechanism indicated above is a solution for generating three positions for the pile warp threads with only two complementary hooks and two lifter elements and two grates.

A disadvantage of this solution is, however, that two lifter elements and two grates (16), (19) are necessary, with the result that the whole machine takes up a large amount of space vertically, so that Jacquard machines provided with this lifter mechanism have to be set up at a very high level, in order to obtain acceptable angles of incidence of the harness cords in the harness cord board.

SUMMARY OF THE INVENTION

The object of this invention is to provide a lifter mechanism for a Jacquard machine, in which the mechanism is more compact in height.

The subject of the invention is a lifter mechanism for a Jacquard machine, in which one lifter element and one roller element fixed to a grate are provided for each set of complementary hooks. Each lifter element comprises two rotary rollers disposed on a common construction, over which rollers respective lifter cords can be guided.

Each roller element is provided with a rotary roller over which a lifter cord can be guided.

The mechanism is set up as follows. The end of a lifter cord is fixed to one hook of a set of complementary hooks. This lifter cord is passed round under a top roller and is fixed by the other end to the other hook of the set of complementary hooks. In that way the lifter element is suspended from the hooks by means of the lifter cord.

The roller element is set up in a fixed manner below the lifter element. A second lifter cord is fixed by one end to one of the abovementioned hooks (next to the first lifter cord), extends downwards and is passed round under the rotary roller of the roller element, and extends back upwards, where it runs over the bottom roller of the lifter element and then extends back downwards. The harness cord is fixed to the downward-hanging end of this lifter cord.

The generation of three possible positions of the warp threads with this lifter mechanism according to the invention is obtained by the different selection possibilities of the hooks, in which no hook at all, or one or the other hook is selected in its top or bottom position (depending on the embodiment of the invention), and the other hook moves up and down with a knife.

On selection of the hook to which one lifter cord is fixed in its top position, the warp threads carried along by the harness cord go into the below and above positions at the moment that the other (complementary) hook is taken into its bottom and top position respectively by the knife.

On selection of the hook to which two lifter cords are fixed, the warp threads carried along by the harness cord go into the middle and above positions at the moment that the other (complementary) hook is taken into its bottom and top position respectively by the knife.

If none of the hooks is selected, the warp threads carried along by the harness cord go into the below and middle positions at the moment that the hook to which a lifter cord is fixed, or the hook to which two lifter cords are fixed, is taken into the highest position by the knife. This mechanism can thus generate 3 different positions for the warp threads in two successive cycles of the knives, only 1 set of complementary hooks being necessary per harness cord.

An advantage of this invention lies in the fact that, through the use of only one lifter element and one fixed roller element per set of hooks, the mechanism is much more compact in height than the mechanisms which are known.

Due to the fact that only one lifter element and one roller element per set of hooks are needed, an additional advantage of the invention is the limited number of parts and the simplicity and low cost of the mechanism.

A mechanism according to the invention can be provided in each case in conjunction with all (or some of the) sets of complementary hooks of a Jacquard machine. These sets of hooks can be disposed in one or more pairs of complementary rows. The different lifter elements are in this case suspended next to each other below their respective sets of hooks, while the respective roller elements are fixed below each lifter element. Such an arrangement of several mechanisms according to the invention on the same Jacquard machine is another subject of the invention.

In a preferred embodiment of the arrangement according to the invention, the roller elements belonging to the same pair of rows of complementary hooks are fixed on a section extending essentially horizontally below said rows and parallel to said rows. Several of such sections situated adjacent to one another and on which roller elements are fixed can be interconnected and form a grate. Such a section or several sections—interconnected or otherwise—can be disposed either fixed or in a movable (=controllable) manner.

In another embodiment of the mechanism according to the invention, at least one of the rollers of the lifter element or the roller of the roller element is disposed or designed in such a way that, when a vertically extending lifter cord is passed over said roller(s) and then extends back vertically, the two vertical lifter cord parts are situated in different vertical planes lying at right angles to the direction of the knives, while the outsides of the flanks of the lifter element and/or the roller element lie at right angles to the direction of the knives.

All rollers (both of the lifter element and of the roller element) are preferably disposed or designed in this way, the object being, on the one hand, to prevent the adjacent vertical lifter cord parts from rubbing against each other and, on the other, to prevent the lifter elements from hanging at an angle. These problems were avoided hitherto by using rollers with different maximum roller diameter.

The advantage of this embodiment thus lies in the fact that rollers with the same maximum roller diameter can be used everywhere.

In a preferred embodiment of this mechanism according to the invention, the abovementioned feature is obtained by placing a roller on a shaft disposed at an angle. What is meant here by disposing at an angle is that said shaft does not lie in a vertical plane extending in the direction of the knives, while the outsides of the flanks of the lifter element and/or the roller element lie at right angles to the direction of the knives.

Further features and advantages of the lifter mechanism and of the arrangement of several lifter mechanisms on a Jacquard machine according to the invention are illustrated by a detailed description of a preferred embodiment, without the invention being thereby restricted to this possible embodiment alone.

BRIEF DESCRIPTION OF THE DRAWINGS

The appended figures, on the one hand, illustrate the above description of the prior art, in which.

While

Figure 1:
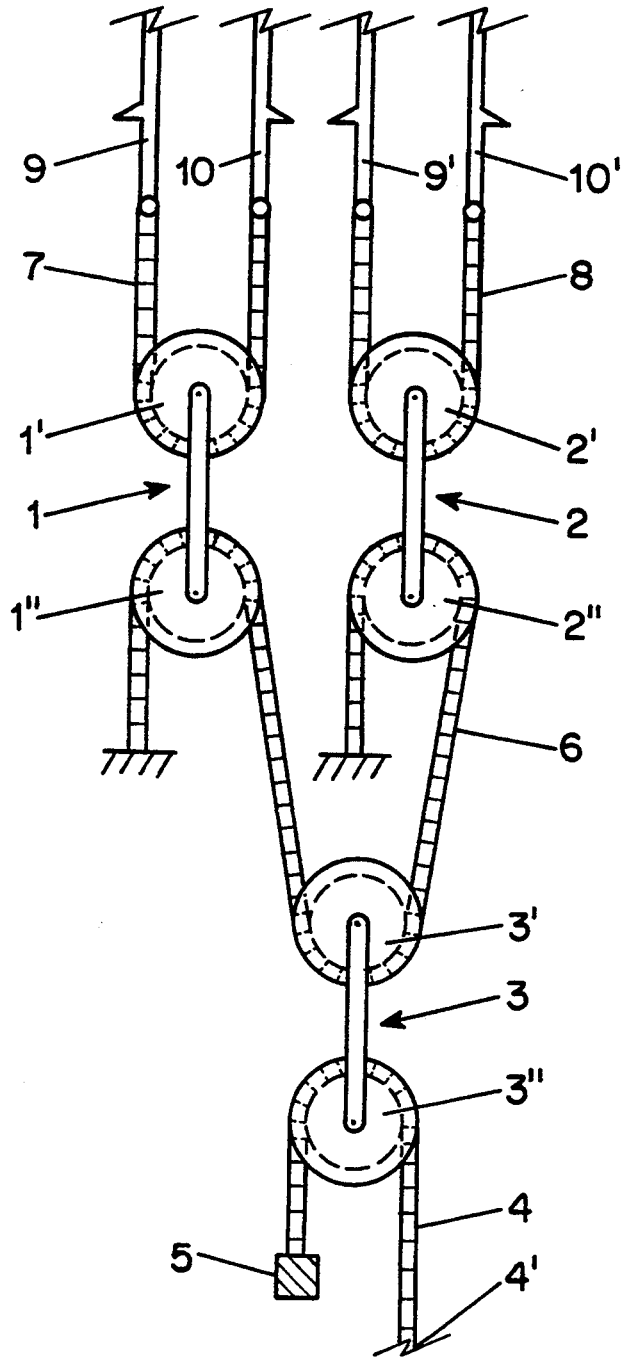
FIG. 1 PRIOR ART
FIG. 1 is a diagrammatic side view of a known lifter mechanism for a Jacquard machine, making use of three lifter elements and two sets of complementary hooks.
Figure 2:
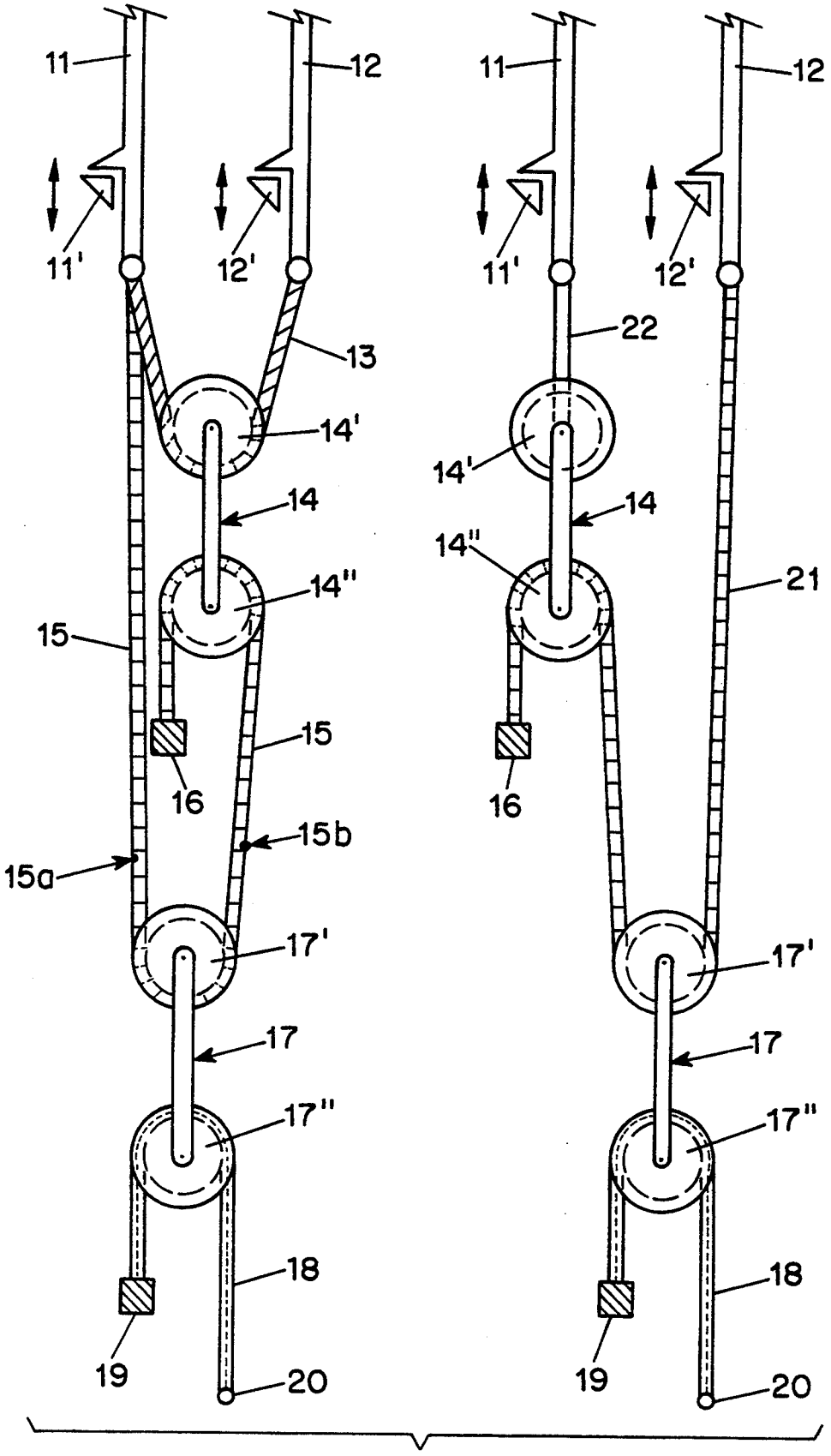
FIG. 2 PRIOR ART
FIG. 2 is a diagrammatic side view of two embodiments of a known lifter mechanism for a Jacquard machine, making use of two lifter elements and 1 set of complementary hooks.
Figure 3:
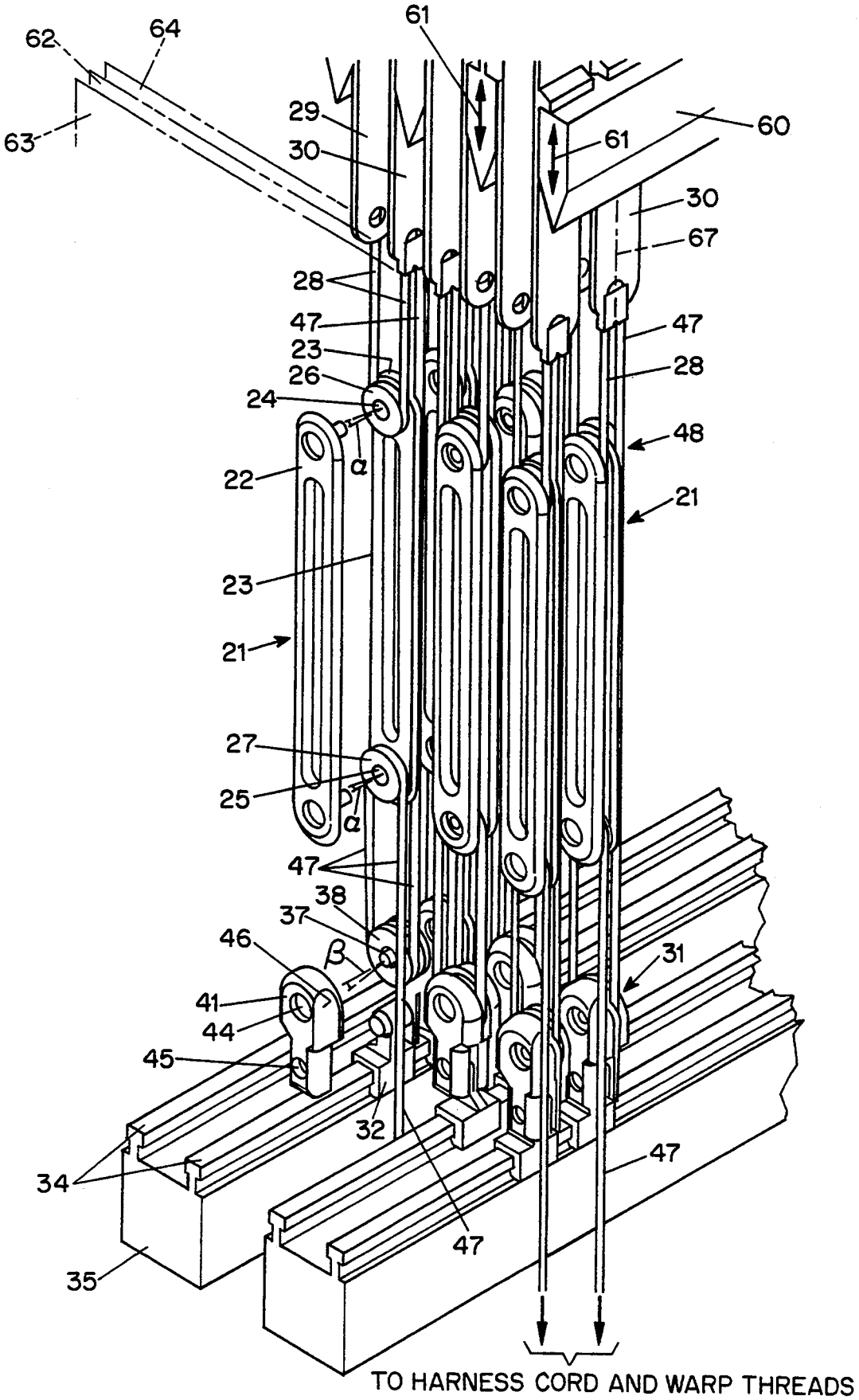
Figure 4:
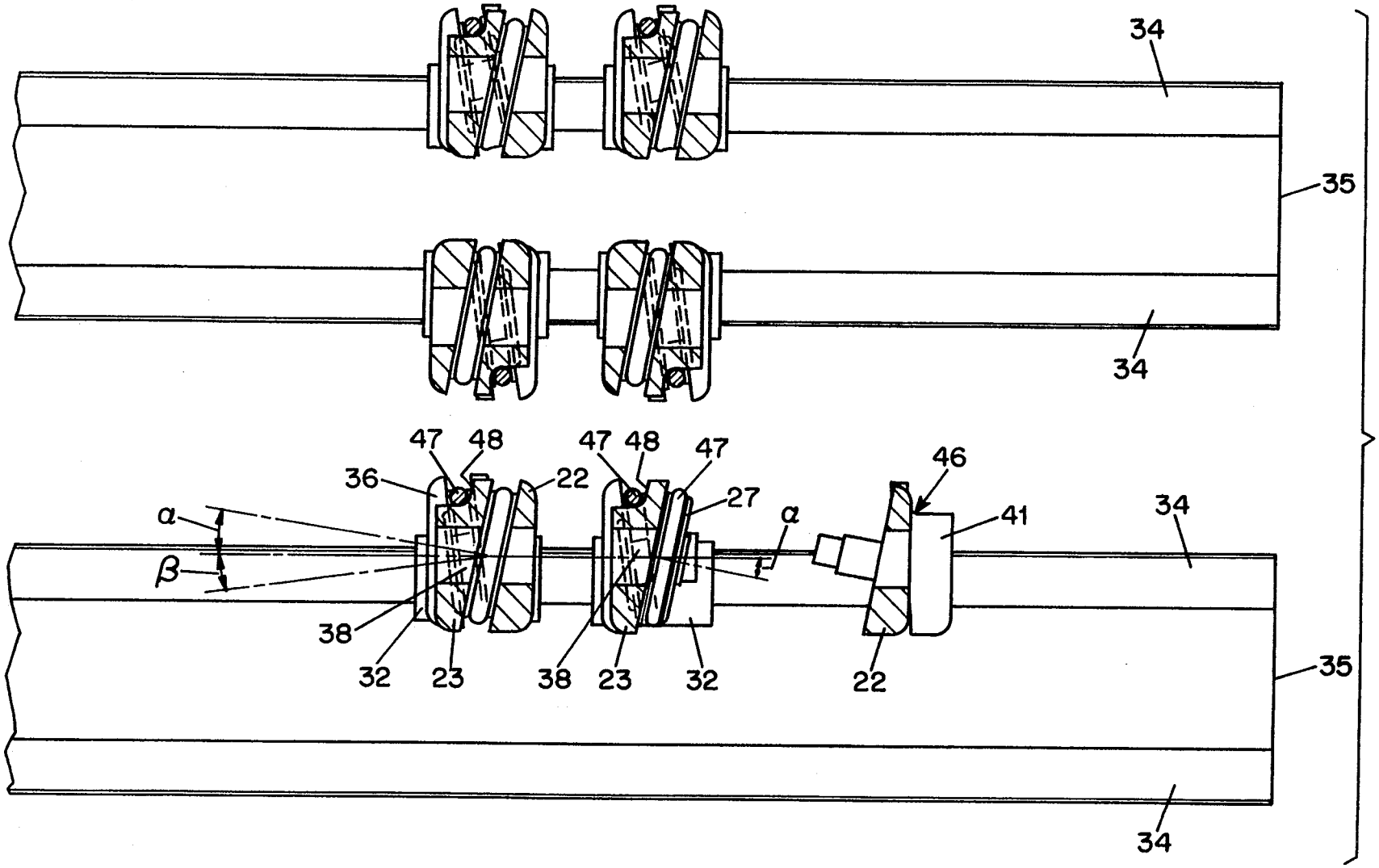
Figure 5:
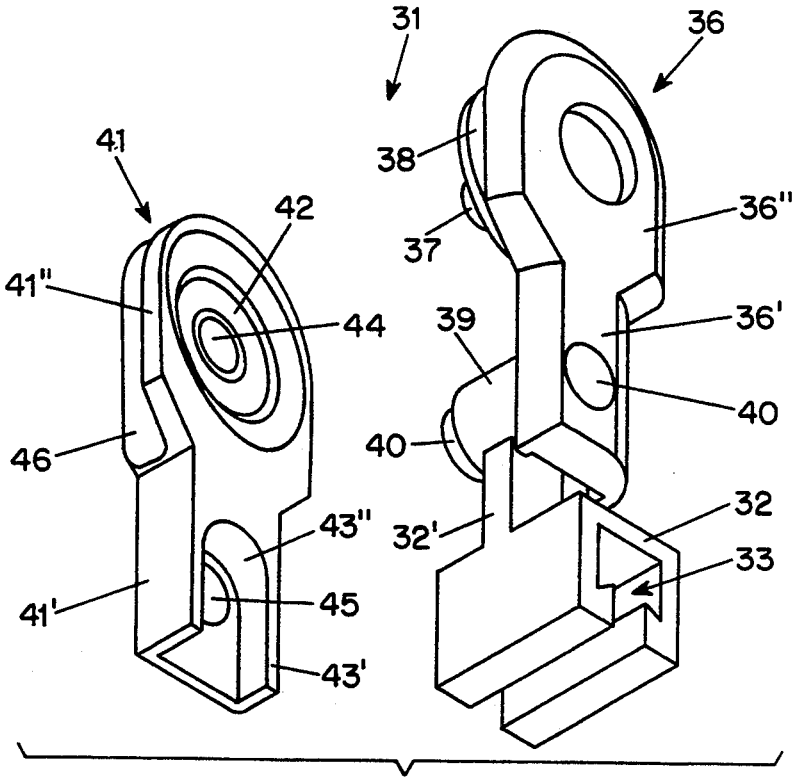
Figure 6:
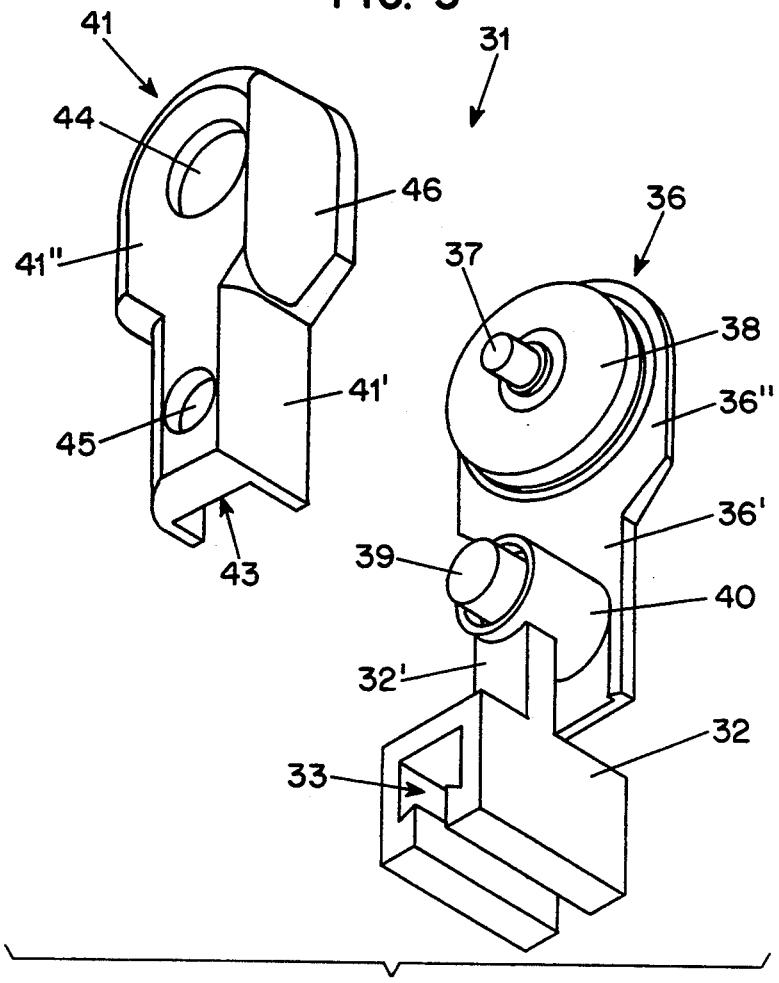

The other appended figures, on the other hand, illustrate the description which follows of a preferred embodiment of the invention, in which:

FIG. 3 shows a perspective view of the arrangement of six lifter mechanisms according to the invention, in conjunction with six sets of complementary hooks, distributed over three pairs of rows of complementary hooks;

FIG. 4 shows a top view of the lifter elements according to the invention from FIG. 3;

FIG. 5 shows a perspective view of a dismantled roller element of a lifter element according to the invention;

FIG. 6 shows a different perspective view of the dismantled roller element of FIG. 5.

DETAILED DESCRIPTION

A preferred embodiment of a lifter mechanism according to the invention comprises a lifter element (21), which is composed of two elongated flank pieces (22), (23) which are fixed together parallel to each other and directly opposite each other with a certain spacing between them. In the vicinity of the ends of these flank pieces (22), (23), shafts (24) and (25) extend between the flank pieces (22), (23), running from one flank piece (22) to the other flank piece (23). The flank pieces (22) and (23) are fixed to each other by means of these shafts.

Roller elements (26), (27) are placed on the shafts (24), (25) respectively. The shafts (24) and (25) are placed parallel to each other, and are not at right angles to the outside of the flank pieces (22) and (23).

The angles ($\alpha$) formed between the axes of the shafts (24) and (25), on the one hand, and the perpendicular of one of the flank pieces (22) or (23) at the level of the shafts (24) and (25), on the other, are consequently identical.

Lifter cord (28) is fixed by one end to the hook (29), in a point which lies on the vertical axis of symmetry (67) of said hook (29), extends vertically downwards, is passed round under the roller (26), and extends vertically back up, where the other end of said lifter cord (28) is fixed to the hook (30), in a point which does not lie on the vertical axis of symmetry of said hook (30). The fixing point of lifter cord (28) to hook (30) does not lie in the vertical line of symmetry of said hook, since a second lifter cord still has to be fixed to the sa/ne hook (30) (see below).

The size of the angle ($\alpha$) between the axis of the shaft (24) of roller (26) and the perpendicular on the outside of the flank piece (22) or (23) is consequently such that the lifter cord (28) can extend downwards from one fixing point in a vertical plane (62) lying perpendicular to the direction (61) of the knives (60) and containing the vertical lines of symmetry of the hooks (29) and (30), is then passed round under roller (26), and can then extend upwards, in another vertical plane (63) at right angles to the direction of the knives (60), to the other fixing point, while the external walls of the flank pieces (22) and (23) are situated in planes at right angles to the direction of the knives (60).

The roller element (31) has a beam-shaped base piece (32), which is provided with a T-shaped recess (33) coming out in the lower wall, so that the roller element (31) can be pushed over one projecting edge (34) of a section (35), which edge fits into the T-shaped recess (33), in order to fix the roller element (31) on said section. The roller element (31) can be fixed on or removed from this edge only by sliding the base piece (32) onto the edge (34) from one end thereof or sliding it off said edge along one end thereof.

An upstanding rib (32') is provided at right angles to the top side of the base piece (32) in the breadthwise direction, on which rib a bush (39) is fixed, extending in the lengthwise direction of the base piece (32). A shaft (40) coming out on either side of the bush (39) is rotatably disposed in said bush (39).

A side plate (36) and a side plate (41) respectively are now fixed on both ends of the rotary shaft (40). Both side plates (36), (41) have at the bottom a part (36'), (41') of elongated shape with parallel edges, and end higher up in a broader head (36''), (41'') respectively, which are rounded off along the top. A shaft (37) is fixed on said side plate (36) along the inside, centrally relative to the head (36''), while a rotary roller (38) is situated on said shaft (37).

The head (41'') of the side plate (41) has along the inside a symmetrical circular cavity (42), while an opening (44) is provided centrally in said cavity. The shape and dimensions of said cavity (42) and of the opening (44), and their position in the side plate (46), are such that, when the side plates (36) and (41) are joined, the shaft (37) can be pushed into the opening (44), and the roller (38) is partially surrounded by the walls of the cavity (42), in such a way that sufficient space is left between the side plates (36) and (41) and around the roller (38) for passing a lifter cord (47) from the top side under said roller (38) and back up, while the roller (38) can rotate about its axis (37).

The side plate (41) has in the bottom part (41') along the inside a U-shaped, deeper down part (43), the parallel walls (43') of which start from the underside of said side plate (41), and merge into each other higher up by means of a curved wall (43''). In this part (43), an opening (45) is provided in the vicinity of the curved wall (43''). The position, shape and dimensions of the part (43) and the opening (45) are such that, when the side plates (36) and (41) are joined, the shaft (40) can be pushed by the end into the opening (45), the bush (39) and the top side of the rib (32') being enclosed by the walls (43') and (43'') of the U-shaped, deeper down part (43) of the side plate (41).

A recess (46) is provided at one side in the outside wall of the side plate (41) of the roller element (31), over the full height of the broadest top part (41''). Said recess (46) forms a recessed angle—with rounded transition between the two angle-forming walls—from the top side of the broadest part (41'') to where said part (41'') merges into the elongated part (41').

The shaft (37) does not lie at right angles to the side plate (36). Between the axis of the shaft (37) and the perpendicular on the outside of the side plate (36)—at the level of the shaft (37)—an angle ($\beta$) which is equal to the angle ($\alpha$) is formed, but the angle ($\beta$) is formed along the other side of the perpendicular from the angle ($\alpha$).

Lifter cord (47) is fixed to the hook (30) at a point which is not situated on the vertical line of symmetry, along the other side of said line of symmetry (67) next to the fixing point of lifter cord (28). Lifter cord (47) extends vertically downwards and is passed round under the roller (38) of the roller element (31). The lifter cord (47) is then taken vertically back up and passed round over the roller (27) of the lifter element (21), and then extends vertically back down.

The angle ($\beta$), which the axis of the roller (38) forms with a perpendicular on the outside of the side plate (36) is such that the lifter cord (47) can extend downwards from the fixing point with the hook (30) (not in a point on the line of symmetry) in a vertical plane (64) at right angles to the direction of the knives (60), is then passed round under roller (38) and can subsequently extend upwards in another plane (62) lying vertical to the direction of the knives, the latter plane containing the vertical lines of symmetry of the hooks (29) and (30), and the outside walls of the side plates (36) and (41) of the roller element (31) lying in planes situated at right angles to the direction of the knives (60).

Due to the fact that the shaft of the roller (27) forms an angle ($\alpha$) with a perpendicular to the flank plate (23), the lifter cord (47), after being passed over the roller (27), is moved from the vertical plane containing the lines of symmetry of the hooks (29) and (30) to a parallel vertical plane, in which the lifter cord (47) extends downwards between the sections (35), and is connected lower down to the warp threads, the latter vertical plane also containing the fixing point of lifter cord (28) to hook (30).

The part of lifter cord (47) which hangs down from the roller (27) consequently extends parallel to and at a certain distance next to the part of lifter cord (47) extending downwards from the fixing point to the hook (30), both lifter cord parts lying on either side of the plane containing the lines of symmetry of the hooks (29) and (30).

The design of roller element (31), and more particularly of the recess (46), is such that the part of lifter cord (47) hanging down from the roller (27) extends downwards at the level of the roller element (31) into the recess (46).

An additional feature of the lifter element (21) is that one of the flank plates (23), on the outside of the vertically extending edge, along which lifter cord (47) extends downwards, has a recess (48) over the full height, with rounded walls which can guide lifter cord (47).

The two side plates (36), (41) of the roller element (31) are hingedly disposed relative to the base piece (32) on the shaft (40). This hinged fixing prevents a bending moment from arising in the roller element (31), as a result of the movement of the grate along an inclined shed.

In the preferred arrangement of several mechanisms according to the invention, a grate consisting of several sections (35) disposed parallel to each other and at a fixed distance apart is provided. Said grate is disposed in such a way that the sections (35) run parallel to the knives (60). Two parallel, projecting T-shaped profiled edges (34) are provided on the top side of each of the sections (35). Several roller elements (31) are fixed next to each other on said edges (34). The site of the sections (35) and of each roller element (31) on the edges (34) of said sections (35) is such that the lifter cords (28), (47), on the one hand, and lifter element (21) and roller element (31), on the other, of a mechanism according to the invention—which are interconnected by means of lifter cords—can extend with vertically extending lifter cord parts and outside walls respectively, which are situated in vertical planes lying at right angles to the direction of the knives (60).

Two rows of lifter mechanisms extending next to each other, and the roller elements (31) of which are fixed on different adjacent walls (34) of adjacent sections (35), are disposed in such a way that the respective lifter cords (47) extend downwards between the same sections (35) towards the warp threads, and that hooks (30), which interact with two such rows of lifter mechanisms, and to which two lifter cords (28), (47) are fixed, are consequently situated adjacent to each other, and that lifter elements (21) and roller elements (31) of the different rows are thus suspended or fixed in such a way that the recesses (48), (46) face each other.

Another advantage of the invention is the slidable fixing of the roller elements (31) on the sections (35), as a result of which a better access to the lifters is obtained, for replacement of parts of the lifter mechanism if necessary.

We claim:

1. Arrangement of one or more lifter mechanisms on a Jacquard machine, each lifter mechanism being connected to first and second complementary hooks, each of which, on each cycle of movement in a direction of a plurality of knives, can either be carried along by one of said knives moving up and down in counterphase or can be held in a top or a bottom position, said hooks being connected by means of lifter cords passed over lifter rollers to one or more warp threads, so that, on two successive cycles of movement of said knives, said warp threads can be moved to three different levels through selection possibilities of the hooks, said hooks forming a plurality of rows, said lifter mechanism comprising:

at least one lifter element having top and bottom rollers and a roller element having one roller, said roller element being fixedly located under first and second complementary hooks, a first lifter cord connected by one end to said first hook, which extends downwards, passes around under said top roller of said lifter element and extends back up, where it is connected by the other end to said second hook, said lifter element hanging below said first and second hooks and above said roller element, and a second lifter cord connected by one end to said second hook next to said first lifter cord, which extends downwards, passes around under the roller of said roller element, extends back up, passes around over said bottom roller of said lifter element, and extends back down, where it is connected to one or more harness cords carrying along the warp threads lower down than said roller element.

2. The arrangement according to claim 1, wherein said lifter element and/or said roller element has flanks so that for at least one of their respective rollers, a first or second lifter cord passes over said roller and extends vertically on either side of said roller in different planes at right angles to the direction of said knives, and the outsides of said flanks of said lifter element and/or said roller element lie at right angles to the direction of said knives.

3. The arrangement according to claim 1, wherein said lifter element, said roller element and/or their respective rollers are so arranged that lifter cord parts extending vertically next to each other on the same side of the rollers extend in different planes lying at right angles to the direction of said knives, said planes being separated a great enough distance to prevent said lifter cord parts from rubbing against each other during the operation of the lifter mechanism.

4. The arrangement according to claim 1, wherein at least one of said rollers is supported on a respective shaft which is not disposed in a vertical plane extending in the direction of said knives.

5. The arrangement according to claim 1, wherein said lifter element comprises top and bottom shafts, each shaft having an axis, and two elongated flank pieces which are fixed in opposed, parallel, relationship to each other, with a predetermined spacing between them, wherein in the vicinity of opposite ends of said flank pieces, said top and bottom shafts extend from one flank piece to the other, wherein said top and bottom rollers are disposed rotatably on said top and bottom shafts, respectively, and wherein each of said flank pieces has a vertically extending edge having an outside.

6. The arrangement according to claim 5, wherein said top and bottom shafts of said lifter element are disposed at an angle ($\alpha$) parallel to each other, so that in a horizontal plane, said angle ($\alpha$) is formed between the axis of each shaft and the perpendicular on the outside of one of said flank pieces at the level of each axis, and that the size of each angle ($\alpha$) and the direction of the slanting arrangement of said top and bottom shafts is such that, when positioning said lifter element, on the one hand, the lifter cord parts of said first and second lifter cords passed around over said top and bottom rollers and extending under said first hook are situated in a first vertical plane containing the fixing point of said first lifter cord to said first hook, and, on the other hand, the lifter cord parts extending under said second hook are situated in a second vertical plane lying at right angles to the direction of said knives, said second plane containing the fixing point of said first lifter cord to said second hook, said fixing point not being on the vertical line of symmetry of said second hook.

7. The arrangement according to claim 6, wherein the flank pieces of said lifter element are so formed that the insides of the flank pieces run parallel to said top and bottom rollers, wherein said top and bottom rollers are disposed at an angle, and wherein, when positioning said lifter element, the outsides of said flank pieces are situated in vertical planes lying at right angles to the direction of said knives.

8. The arrangement according to claim 5, wherein one of the flank pieces of said lifter element on the outside of the vertically extending edge, along which said second lifter cord extends downwards, has a recess over the full height of the vertically extending edge of one of the flank pieces, wherein walls of said recess are adapted to guide said second lifter cord.

9. The arrangement according to claim 1, wherein said roller element comprises a base piece having means for fixing thereof and first and second upstanding side plates, each having an inside and an outside, are hingedly fixed on said base piece, wherein said fixing means and the hinged fastening of said first and second side plates are hingedly disposed relative to a first horizontal shaft which is directed at right angles to the direction of said knives, wherein a second shaft extends from said first side plate to said second side plate, and said roller is rotatably fixed on said second shaft, and wherein said second shaft has a slanting arrangement with a direction.

10. The arrangement according to claim 9, wherein said second shaft of said roller element is disposed at an angle such that in a horizontal plane an angle ($\beta$) is formed between the axis of said second shaft and the perpendicular on the outside of one of said first and second side plates at the level of said axis, and wherein the size of said angle ($\beta$) and the direction of the slanting arrangement of said second shaft are such that, on the one hand, parts of said second lifter cord are passed around over the roller of the roller element and extending under said first hook are situated in a first vertical plane lying at right angles to the direction of said knives, said plane containing the fixing point of said first hook, on the vertical line of symmetry of said first hook, and, on the other hand, parts of said second lifter cord extending under said second hook are situated in a second vertical plane lying at right angles to the direction of said knives, said plane containing the fixing point of said second lifter cord to said second hook, wherein the fixing points of the first and second lifter cords are situated on both sides of the vertical line of symmetry of the second hook.

11. The arrangement according to claim 10, wherein said plates of said roller element are formed such that the insides of said side plates run parallel to said roller disposed at an angle, and wherein said first and second side plates and said fixing means are arranged so that on fixing of said roller element the outsides of said first and second side plates are situated in vertical planes lying at right angles to the direction of said knives.

12. The arrangement according to claim 11, wherein said roller element has a beam-shaped base piece having formed therein a T-shaped recess coming out in a lower wall thereof, wherein an upstanding rib is provided at right angles to a top wall of said base piece extending perpendicular to a longitudinal axis of said base piece, on which rib a bush is fixed symmetrically, extending horizontally parallel to said longitudinal axis of said base piece, in which said first horizontal shaft is rotatably disposed, wherein said first and second side plates are respectively fixed on opposite ends of said first horizontal shaft, both of said side plates having along their bottom, at the level of their fixing point, an elongated part with parallel edges, and terminate higher up in a broader head which is rounded off along the top, wherein said second shaft on which the roller is supported is fixed on said first side plate centrally relative to its rounded head, wherein centrally in the rounded head of said second side plate a symmetrical circular cavity having parallel walls is provided, and an opening is provided centrally in said cavity, wherein said second shaft is supported in said opening, and said roller is partially surrounded by walls of said cavity, wherein sufficient space is provided between said first and second side plates and around said roller for passing said second lifter cord from the top side under said roller and back up, wherein a lower part of said second side plate has along the inside a U-shaped cavity deeper than said circular cavity having parallel walls which start from the underside of said second side plate and merge into each other higher up by means of a curved wall, and wherein an opening, in which said first horizontal shaft sits is provided in said U-shaped cavity in the vicinity of said curved wall.

13. The arrangement according to claim 12, wherein a recess having walls is provided at one side in the outside wall of one of said first and second side plates of said roller element, over the full height of the broader head thereof, the walls of which recess are adapted to guide the lifter cord part extending downwards towards the warp threads.

14. The arrangement according to claim 12 including a plurality of lifter mechanisms and rows of first and second hooks, wherein said roller element of each of the lifter mechanisms which interact with said first and second hooks of the same pair of rows of complementary hooks are fixed next to each other on a same section running parallel to said rows.

15. The arrangement according to claim 14, wherein said roller elements which interact with first and second hooks of the same pair of rows of complementary hooks are fixed on sections each having a top side, at least one projecting edge with a T-shaped cross-section and extending in said horizontal direction parallel to said longitudinal axis, and corresponding in shape and size to said T-shaped recess formed in the base piece of said roller elements, said roller elements being fixedly attached to said edge, wherein the T-shaped edge lies in the T-shaped recess.

16. The arrangement according to claim 14, wherein roller elements which interact with said first and second hooks of different pair of rows of complementary hooks are fixed on different adjacent sections, and interconnected to form a fixed or movable grate.

17. The arrangement according to claim 14, wherein each section is provided with two upwardly projection edges each having a T-shaped cross-section, wherein roller elements which interact with hooks of adjacent pairs of complementary hooks are fixed on adjacent edges of the same section or of adjacent sections, and wherein the lifter mechanisms of which roller elements are fixed on different adjacent edges of adjacent sections are disposed in such as way that the respective second lifter cords extend downwards between the same sections towards the warp threads, with the hooks of said lifter mechanisms to which both first and second lifter cords are fixed lying opposite each other.

18. The arrangement according to claim 1, wherein said roller element is on a fixed grate.

19. The arrangement according to claim 1, wherein said roller element is on a movable grate.

* * * * *